US006553203B2

(12) United States Patent
Van Weverberg

(10) Patent No.: US 6,553,203 B2
(45) Date of Patent: Apr. 22, 2003

(54) SLIPLESS DRIVE IMAGE REPRODUCTION

(75) Inventor: Erik Van Weverberg, Mortsel (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 09/942,403

(22) Filed: Aug. 29, 2001

(65) Prior Publication Data

US 2002/0085865 A1 Jul. 4, 2002

(30) Foreign Application Priority Data

Aug. 30, 2000 (GB) ..... 0021146

(51) Int. Cl.[7] ..... G03G 15/16
(52) U.S. Cl. ..... 399/302; 399/66; 399/167
(58) Field of Search ..... 399/66, 159, 162, 399/165, 167, 302, 308, 396, 400

(56) References Cited

U.S. PATENT DOCUMENTS 5,946,525 A * 8/1999 Okamura et al. ..... 399/66

FOREIGN PATENT DOCUMENTS

JP 57-53759 3/1982
JP 1-115669 5/1989

* cited by examiner

*Primary Examiner*—Hoang Ngo
(74) *Attorney, Agent, or Firm*—Knobbe Martens Olson & Bear, LLP

(57) ABSTRACT

The present invention is related to slipless drive image reproduction systems, such as printers and copiers, having one or more intermediate transfer members between the image-forming member and the receptor material. In operation, images are formed on the image-forming member and transferred via the intermediate transfer member to a face of the receptor material. These subsequent transfers are executed in transfer contact zones where the respective image-carrying members contact each other. The respective image-carrying members are coupled and driven such that the losses created in the transfer contact zones are balanced over the respective drive device.

14 Claims, 3 Drawing Sheets

SLIPLESS DRIVE IMAGE REPRODUCTION

FIELD OF THE INVENTION

The present invention is related to an image reproduction system wherein a developed image is transferred from an image-forming member to a receptor material via at least one intermediate transfer member with control of image distortion.

BACKGROUND OF THE INVENTION

In a typical image reproduction system such as a printing or a copying system, a latent image is formed on an image-forming member by image-wise exposure using a known graphical process. The image-forming member can be an endless member such as a drum or a belt. Typical graphical processes include amongst others magnetography, ionography, elcography and electrography, particularly electrophotography. At present electrophotography is the most widespread. In the latter process, a charged latent image is formed on a pre-charged photosensitive member by image-wise exposure to light. The latent image is subsequently made visible on the image-forming member with charged toner at a development zone. After the development of the latent image, the developed toner image is transferred directly to a receptor material. The receptor material can be in the form of a web or in sheet form. In the latter case, the receptor material is preferably on a conveyor. An example of such an image reproduction system is disclosed in European patent EP629924 (Xeikon N.V.). A disadvantage of these direct transfer type of image reproduction systems are the stringent requirements which the recording media have to meet. It is widely known that for instance the electrical and thermal properties of the receptor material and particularly the accurate control of these properties determine to a large extent the quality and reproducibility of the images which are transferred and potentially fixed to the receptor material. The control of these properties, i.e. the conditioning of the medium, can be implemented in various ways, such as e.g. demonstrated in EP629925 (Xeikon N.V.). In general however, to enable the ability to print on a wide range of recording media one has to go first through an elaborate medium qualification procedure and thereafter through a demanding medium condition procedure.

Amongst others, in order to overcome or at least facilitate these procedures, reproduction systems of the new generation are provided with at least one intermediate transfer member between the image-forming member and the receptor material. In such systems the developed image is transferred from the image-forming member to the receptor material via one or more intermediate transfer members, usually in the form of endless belts or drums. A typical example of such a system is disclosed in U.S. Pat. No. 6,047,156 (De Bock et al., Xeikon N.V.). It is a clear benefit that the use of intermediate transfer members obviates the need for the conditioning of the receptor material or at least makes the conditioning less demanding. The use of intermediate transfer members introduces extra image transfer zones, i.e. regions where a first moving image carrying member and a second moving image carrying member contact each other in order to transfer a developed image from the first moving image carrying member to the second moving image carrying member. For instance, the reproduction system as disclosed in U.S. Pat. No. 6,047,156 uses two intermediate transfer members per side and by consequence each developed image has to pass through three transfer zones, being the transfer zones between the image forming member and the first intermediate transfer member (i.e. the primary belt), between the first and the second intermediate transfer member, and between the second intermediate transfer member and the receptor material. One of the problems which may appear at each transfer zone is image distortion and particularly image stretching or shrinking. The term "image distortion" as used herein is intended to include both image size reduction as well as image size magnification. There are a number of parameters which may affect image magnification such as the contact pressure, the temperature and the properties of the respective image-carrying members, such as for instance surface roughness, thickness, elasticity, stiffness and surface energy. But even when all these parameters are properly controlled, the mutual forces in the contact zones exerted by the respective moving image-carrying members on each image carrying member will significantly influence image magnification. These forces are to a large extent determined by the drive and coupling strategy of the image carrying members in the image reproduction system.

OBJECTS OF THE INVENTION

It is an object of the invention to provide an image reproduction system having in operation at least one intermediate image carrying member contacting at least one other image carrying member, wherein these respective image carrying members are driven in a smooth and slipless way in order to control image distortion and particularly image stretching and shrinkage in the transfer contact zone.

It is a further object of the invention to provide an image reproduction system having at least one intermediate image carrying member, wherein during start-up the respective image carrying members are driven and coupled in a smooth and slipless way to control and limit the overall image distortion and particularly image stretching and shrinkage.

SUMMARY OF THE INVENTION

In an aspect of the invention a method is disclosed for controlling image distortion in the transfer contact zone between a first and a second moving image-carrying member, being part of an image reproduction system, by driving said first image-carrying member with a first drive device, capable of speed and torque control, and driving said second image-carrying member with a second drive device, capable of speed and torque control, such that the force exerted by the first moving image-carrying member on the second moving image-carrying member is countered by the force exerted by the second moving image-carrying member on the first moving image-carrying member.

The countering of the force exerted by the first moving image-carrying member on the second moving image-carrying member by the force exerted by the second moving image-carrying member on the first moving image-carrying member is preferably such as to result in a substantially balanced condition. This balancing is preferably achieved by substantially equally dividing the additional load created in the transfer contact zone by engaging said first moving image-carrying member against said second moving image carrying member over said first and said second motor. At start-up, the first and second image-carrying members are disengaged. The first image-carrying member is driven in speed control mode by a first drive device, capable of speed and torque control. The second image-carrying member is driven in speed control mode by a second drive device, capable of speed and torque control. Both image-carrying members are ramped up to about the same predetermined linear speed. As, when coupled, the first image-carrying member will be the "slave" and the second image carrying member will be the "master", it may be advantageous to drive the first image-carrying member at a slightly higher speed, typically up to 5% higher, compared to the speed of the second image-carrying member. The de-coupled current and voltage values of the drive devices are stored. Then the maximum current of the first drive device is set to a value slightly higher than its de-coupled value. Next, the two moving image-carrying members are coupled thereby creating a transfer contact zone. In a preferred construction, the first and the second image-carrying member pass over respective guide rollers so positioned, in the coupled position of the first image-carrying belt with the second image-carrying belt, to form a transfer contact zone therebetween. At least one of these guide rollers is movable to enable the first and the second image-carrying belt to be de-coupled from each other.

Due to the coupling action, the first drive device goes into a torque controlled mode and its current equals the set point current. The second drive device is still speed controlled. By consequence, due to the losses created by the coupling in the transfer zone, i.e. the additional load, the current of the second drive device increases. This is now a clearly unbalanced situation as the losses are fully compensated by the second drive device. An approach to obtain a balanced situation is as follows. The set point current of the torque controlled first drive device is gradually increased till the current of the second drive device equals the current of this motor in its de-coupled state. Then, the current of the first drive device is measured and the difference is calculated between this current and the current of the first drive device in its de-coupled state. Finally, a new set point current is introduced for the first drive device being the current of this motor in de-coupled state raised with 50% of said difference. By doing so the current of the second drive device, which is speed controlled, is allowed to increase till a stationary value is reached. The losses in the transfer zone are and will remain equally shared over the respective drive devices.

The first image-carrying member can be an image-forming member or an intermediate transfer member, while the second image carrying member can be an intermediate transfer member or a receptor material. Examples of image-forming members are drums or belts with a photoreceptive or a magneto-sensitive outer layer. Examples of intermediate transfer members are seamed or seamless intermediate transfer belts. Such an intermediate transfer belt may be composed of an electrically semi-insulating or insulating material with a low surface energy, or comprises at least a top coating of such a material. Examples of such a material are polyesters such as e.g. Hytrel 7246, polyimides, polycarbonates or dissipative polymer blends. A plurality of intermediate members, being drums or belts, can be used. The intermediate transfer member in contact with the receptor material is preferably a belt. More preferably, the intermediate transfer member in contact with the receptor material is a belt being at least locally heated prior to contacting the receptor material to simultaneously transfer and fuse the image to the receptor material. This belt may comprise an electrically conductive backing member, such as a metal, covered for example with a silicone elastomer, polytetrafluoroethylene, fluorosilicones, polyfluoralkylene and other fluorinated polymers. Optionally, on top, a semi-insulating or insulating coating layer of, for example, a fluorosilicone, may be formed. Alternatively, a fabric backing may be used covered with a conductive (conformable) silicone layer, optionally covered with a top coating. In case a fabric backing is used, a pre-stressed fabric backing or a reinforced fabric backing is preferably used to increase the belt stiffness.

The receptor material can be in web form or in sheet form. In the latter case, the receptor material is preferably transported on a conveyor. Typical materials are paper, films, label stock, cardboard etc.

In another aspect of the invention, an image reproduction system is disclosed which includes a device for transferring developed images from an image-carrying member to one face of a receptor material, comprising a transfer member capable of being coupled with, and de-coupled from, both said image-carrying member and said receptor material, wherein said transfer member and said receptor material pass over respective guide rollers so positioned, in the coupled position of said transfer member with said receptor material, to form a transfer contact zone therebetween;

a first drive device for tensioning said receptor material; and a second and a third drive device, both capable of speed and torque control, for driving said transfer member and said receptor material respectively such that the additional load created in said transfer contact zone is balanced between said second and third drive device.

To enable the simultaneous transfer and fusing of a developed image on the receptor material, the transfer member can be at least locally heated prior to the transfer contact zone. By arranging for the heated transfer member to be de-coupled from the receptor material, at shut-down, the risk of overheating the receptor material and possibly causing a fire hazard is reduced.

The image-carrying member can be an image-forming member such as e.g. a photosensitive drum. Dependent on the application envisaged, whether it concerns a monochrome or a multi-colour reproduction system, a single pass or a multi-pass system, in operation, a single or a plurality of image-forming members, each of a separate colour, may contact the image-carrying member in a first transfer contact zone or in a plurality of first transfer contact zones, when appropriate. The image-forming member(s) may be de-coupable and separately driven by a drive device capable of speed and torque control. If so, the losses due to the contacting in the first transfer contact zone(s) can be balanced between the drive device of the image-carrying member and the drive device of the respective image-forming member. Alternately, the image-forming member(s) can be driven by adherent contact with the image-carrying member, see e.g. U.S. Pat. No. 5,808,967 (De Bock et al., Xeikon N.V.). In this case, no separate drive devices are provided for driving the image forming member(s).

The image-carrying member can be an intermediate transfer member. A separate drive device, capable of speed and torque control is provided to independently drive the intermediate transfer member. In a preferred construction, the intermediate transfer member and the transfer member pass over respective guide rollers so positioned, in the coupled position of the intermediate transfer member with the transfer member, to form an intermediate transfer contact zone therebetween. At least one of these guide rollers may be movable to enable the intermediate transfer member and the transfer member to be de-coupled from each other. The additional load created in said second transfer contact zone is balanced between the drive devices of the intermediate transfer member and the transfer member respectively.

One or both of the image-carrying member and the transfer member are preferably in the form of members having a continuous surface, in particular in the form of endless belts. In the following general description, where reference is made to belts, it is to be understood that a belt could be replaced by another member having a continuous surface, such as a drum, where the context so allows.

Besides the benefits already mentioned, including slipless drive, the present invention has a number of additional advantages. At start-up, the transfer belt, the image-carrying belt and the receptor material can be brought up to speed before coupling, reducing the shock to delicate components of the printer. Distortion when the reproduction system remains idle for a significant period of time is also avoided.

An added advantage of being able to run the image-carrying belt at a controlled speed in the de-coupled state independent of the transfer belt and the receptor material, is that calibration of the printing process can be undertaken with the image-carrying belt running at a reduced speed, enabling a higher level of toner to be deposited enabling the calibration to be made more accurately.

The following is of particular interest for receptor materials in web form. By enabling the web to be brought up to speed in the de-coupled state after the image-carrying belt and the transfer belt are already running, indeed even after the transfer belt and the image-carrying belt are coupled with each other, reduces the loss of receptor material which otherwise occurs at start-up of the printer. The web can be brought up to speed and coupled with the already moving transfer belt once the latter has reached its operating temperature and just as the first image to be transferred is approaching. The issue involved is an issue of synchronization. This is handled in the co-pending patent application EP1079283 (Xeikon N.V.).

The speeds of the image-carrying belt, the transfer belt and the tensioned receptor material are adjusted while these respective members are de-coupled such that they will all be moving at about the same speeds, within predetermined thresholds. Subsequently all these respective members are coupled such the losses of the respective transfer contact zones are balanced over the respective drive motors. Particularly, the coupling may be such that the only direct controlled drive device left, is the second drive device which drives the receptor material. The receptor material is set to a predetermined speed and acts as the "master", while the other image-carrying members act as "slaves". To accomplish this, first the intermediate transfer member is slaved to the transfer member such that the losses in the intermediate transfer contact zone are balanced over the respective drive device. Subsequently, the transfer member, which is already coupled to the intermediate transfer member, is slaved to the receptor material such that by controlling the drive of the receptor material, the entire system is controlled. This balanced configuration not only minimizes the effect of image distortion in each transfer contact zone, but assures also that the image distortion remains substantially unchanged over time. This control over the image distortion on component level is quite important because, although it is nearly impossible to correct for a fluctuating overall image distortion adequately, it is rather straightforward to adjust for a constant and limited overall image distortion on a system level by control of the writing speed on the image-forming member(s).

To achieve speed adjustments in de-coupled and/or coupled state, the reproduction system may further include devices for measuring the speeds respectively of the image-carrying belt, the transfer belt and the receptor material and a control device for adjusting the power fed to the drive devices. The device for measuring the speed of the image-carrying belt may include an encoder driven by the image-carrying belt. This arrangement is preferred over the positioning of an encoder on the associated drive device. Similarly, the device for measuring the speed of the receptor material may include an encoder driven by the receptor material. The device for measuring the speed of the transfer belt may include a device for detecting the passage of one or more timing marks on the transfer belt past a predetermined location.

The drive devices are preferably in the form of independently controllable drive motors. The drive devices are preferably selected from electric motors. In a preferred embodiment, at least the two slave drive motors, and preferably also the master drive motor, are each constituted by a DC drive motor controllable between at least two operating modes, namely a constant speed mode and a constant torque mode. Such motors operate in such a manner that the application of a constant voltage corresponds to the constant speed mode while the application of a constant current corresponds to the constant torque mode.

The reproduction system may be adapted for duplex reproduction, by further including a further image-carrying member, a further transfer member capable of being coupled with the further image-carrying member and the receptor material to transfer images from the further image-carrying member to the opposite face of the receptor material, the further image-carrying member and the further transfer member having respective controllable further drive motors associated therewith.

Duplex printing may be then achieved by driving the further image-carrying member, and the further transfer member while the further transfer member is de-coupled from the further image-carrying member and the receptor material, and thereafter coupling the further transfer member with the further image-carrying member and the receptor material such that the losses created in the respective transfer contact zones are shared over the respective members.

DETAILED DESCRIPTION OF THE INVENTION

In relation to the appended drawings the present invention is described in detail in the sequel. It is apparent however that a person skilled in the art can imagine several other equivalent embodiments or other ways of executing the present invention, the spirit and scope of the present invention being limited only by the terms of the appended claims.

Figure 1:
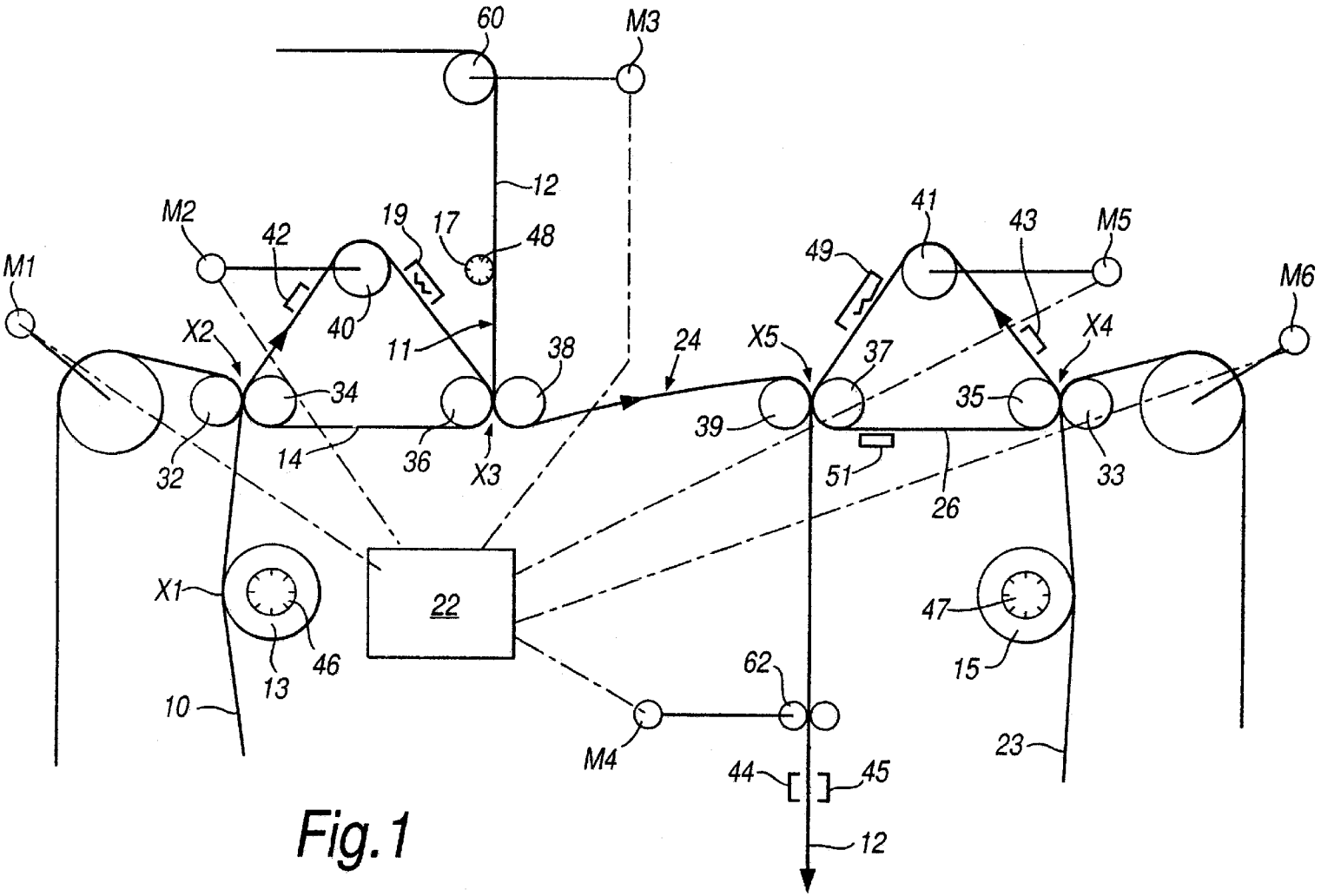
FIG. 1 is a diagrammatic representation of part of a printer according to the invention, in its fully coupled position.

In a preferred embodiment of the invention, see FIG. 1, a schematic representation of an electrophotographic colour printer is depicted incorporating a plurality of image-carrying members according to the present invention. As shown in the figure, the printer includes an endless image-carrying belt 10 on which a registered multi-colour toner image is formed, and an endless transfer belt for transferring the registered multi-colour toner image to one face 11 of a receptor material in the form of a paper web.

The image-carrying belt has a toner image-carrying surface formed of polyethylene terephthalate. As described in U.S. Pat. No. 5,805,967, referred to above, a plurality of coloured toner images are transferred by means of electrostatics in register with each other to the image-carrying belt 10 from the photoconductive surfaces of a plurality of image-forming drums, of which only one drum 13 is shown in the figures for the sake of clarity. The transfer is executed at first transfer contact zones X1 where adherent contact is established between the respective drums and the image-carrying belt. The image-carrying belt 10 is driven by a first DC drive motor M1, connected to a micro-processor control device 22. This first DC drive motor is capable both of speed and torque control. An encoder 46 mounted on the image forming drum 13 and therefore driven by the image-carrying belt 10, measures the speed of the image-carrying belt 10, and feeds this information to the control device 22.

Figure 2:
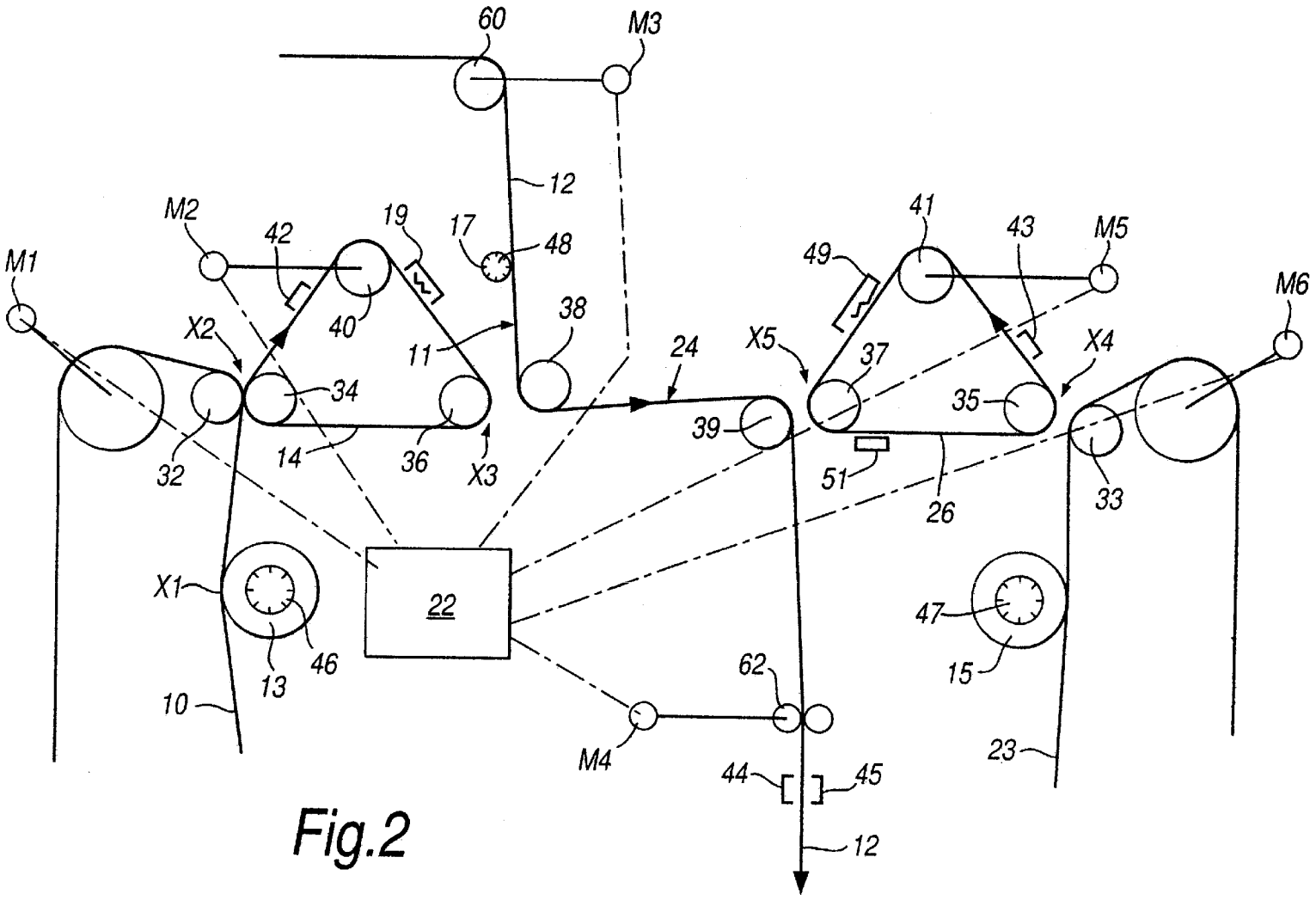
FIG. 2 is similar to FIG. 1, but shows the fully de-coupled position.

At the intermediate transfer contact zone X2, the multi-colour toner image is transferred to a transfer belt 14, which forms a nip with the image-carrying belt 10. In the coupled position, this intermediate transfer contact zone is formed between the guide roller 32 and an opposing guide roller 34 pressed towards each other to cause tangential contact between said image-carrying belt 10 and the heated transfer belt 14. The transfer belt 14 is an endless metal belt of 70 $\mu$m thickness coated with 25 $\mu$m thickness silicone rubber. The guide roller 32 comprises an electrically conductive core carrying a semi-insulating covering. A supply of electrical potential is provided for electrically biasing at least the first guide roller 32 to create an electrical field at the intermediate transfer contact zone to assist in transferring the image to the transfer belt. The position of the guide roller 32 can be adjusted between the coupled position and a de-coupled position where the two belts are spaced from each other and the nip at the transfer zone X2 opened, as shown in FIG. 2. A second controllable DC drive motor 18, connected to the control device 22, is provided for driving the transfer belt 14. This second DC drive motor is capable both of speed and torque control. A fixed optical sensor 42 is provided for detecting the passage of timing marks on the transfer belt 14 past that location so as to enable the speed of the transfer belt 14 to be measured. Both the first DC drive motor and the second DC drive motor are operated such that additional load created in the intermediate transfer contact zone by engaging the respective belts against each other is balanced over said drive motors to thereby obtain slipless drive and control image distortion.

The slipless separate drive of both belts according to the present invention enables for the transfer belt and the image-carrying belt to be in contact with each other over a contact zone without significant transfer of heat from one belt to the other during printing, while enabling the belts to be de-coupled from each other avoids any heat transfer occurring at shut-down. As a consequence, the transfer belt needs not to be cooled or at least not so substantially.

The transfer belt 14 with the transferred multi-colour image is advanced to a final transfer contact zone X3. Prior to entering this final contact zone, the transfer belt is heated using e.g. a radiant heater 19 or a heated roller. In the coupled position, the final transfer contact zone comprises a nip formed between a guide roller 36 of the transfer belt 14 and a counter roller 38, through which nip the transfer belt 14 and a receptor material in the form of a paper web 24 pass in intimate contact with each other. The guide roller 38 is movable to enable the web 12 and the transfer belt 14 to be de-coupled from each other and the final transfer contact zone X3 to be opened, as shown in FIG. 2.

A third controllable DC drive motor M3 and a fourth controllable DC drive motor M4, connected to the control device 22, are provided for driving the paper web 12. The third drive motor M3 drives a paper web tensioning roller 60 and is capable of speed and torque control. The fourth motor M4, which is used for tensioning the web, drives a paper web tensioning roller 62 and is torque controlled. A typical web tension of 300 N is used. An encoder 48, mounted on a guide roller 17 which is driven by the paper web 12, measures the speed of the paper web 12, and feeds this information to the control device 22. A fixed optical sensor 44, connected to the control device 22 is provided for detecting the passage of images on the paper web 12 past that location.

When the printer is in the coupled state, the multi-colour image is transferred from the intermediate transfer belt to the paper web at the final transfer zone X3. The second and third drive motor M2, M3, are driven such that the additional load created by engaging the paper web 12 against the transfer belt 14 at the final transfer contact zone X3 is balanced over these respective motors.

Figure 3:
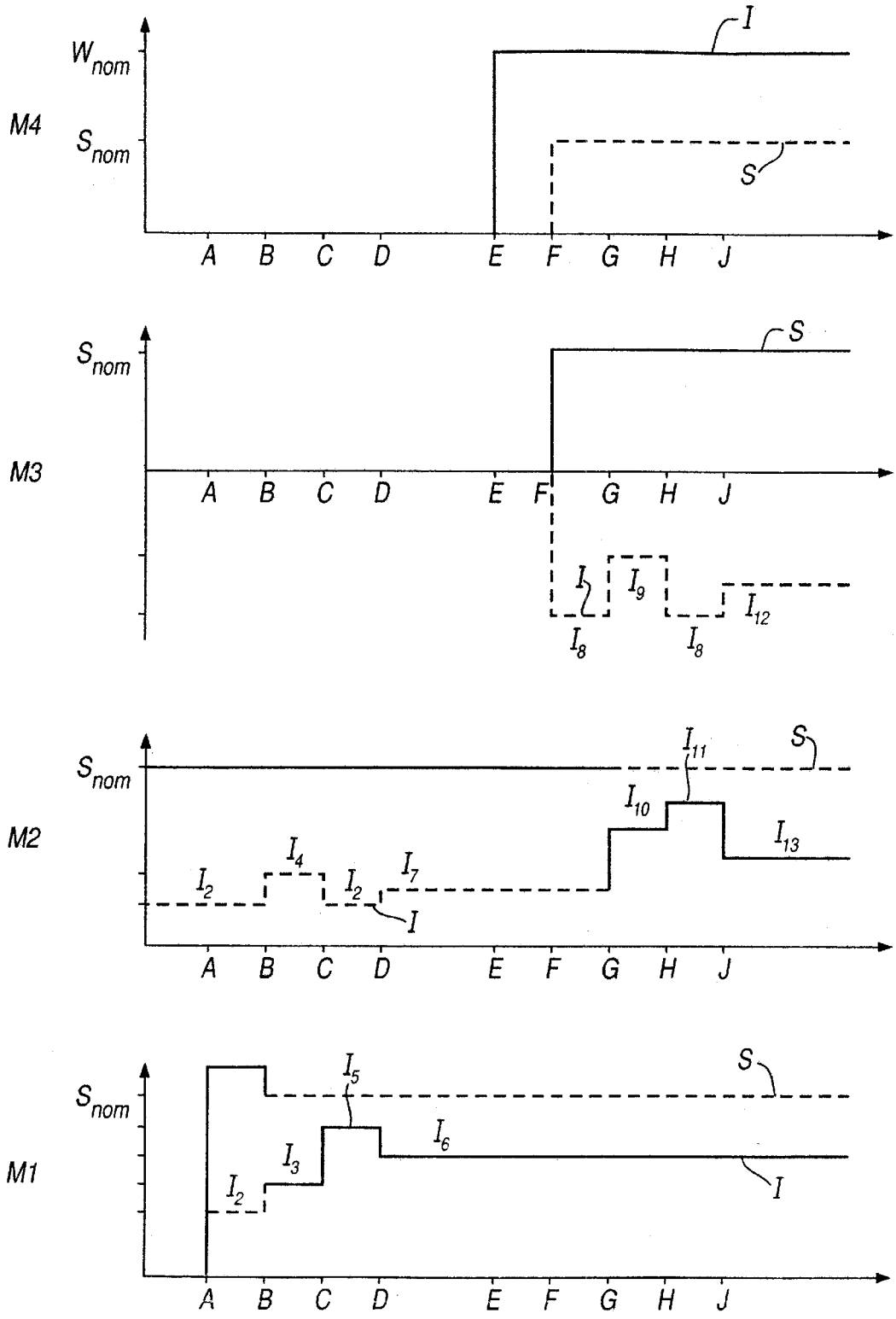
FIG. 3 is a representation of the slipless drive and coupling sequence of a simplex printer with two intermediate transfer members.

The printer is operated in the following manner. The slipless drive and coupling sequence of the printer, operating in simplex mode, is illustrated in FIG. 3. In FIG. 3, the controlled parameters are represented by a fully drawn line, while the other parameters are represented by a dashed line.

At start-up (point O on FIG. 3), the image-carrying belt and the transfer belt are disengaged. The transfer belt 14 is driven in speed control mode by a second drive motor (M2) and is ramped up to a predetermined linear speed, $S_{nom}$. The speed of the transfer belt is measured by detecting signals from the optical sensor 42.

At point A, the image-carrying member 10 is driven by motor M1 in speed control mode. The speed of the image-carrying belt 10 is measured by detecting signals from the encoder 46. The control device 22 adjusts the voltages applied to the motors M1, M2 so as to approximately match $S_{nom}$. In fact, since, when coupled, the image-carrying belt will be slaved to the transfer belt, the image-carrying belt is preferably driven at a slightly higher speed, typically up to 5% higher, compared to the speed of transfer belt. The de-coupled current $I_1$, $I_2$ and voltage values of M1 and M2 are noted. Then the maximum current of M1 is set to a value 13 slightly higher than its noted value.

Before the first image reaches the first transfer nip at the transfer zone X2, the roller 32 is moved to the coupled position to bring the image-carrying belt and the transfer belt into contact with each other at the intermediate transfer contact zone X2 (point B in FIG. 3). Due to the coupling action, motor M1 goes into a torque controlled mode and its current equals the set point current $I_3$. M2 is still speed controlled. In this manner it is ensured that substantially no drive is transferred from the transfer belt 14 to the image-carrying belt 10 and that the image-carrying belt 10 does not constitute a load on the drive motor 18. Due to the losses created by the coupling in the transfer contact zone X2, i.e. the additional load, the current of M2 increases $I_4$. This is now a clearly unbalanced situation as the losses are almost fully compensated by motor M2. An approach to obtain a balanced situation is as follows.

At point C, the set point current of the torque controlled motor M1 is gradually increased to $I_5$ till the current of motor M2 equals the current $I_2$ of this motor in its de-coupled state. Then, the current of motor M1 is measured and the difference is calculated between this current $I_5$ and the current $I_3$ of motor M1 in its de-coupled state.

Finally, at point D, a new set point current $I_6$ is introduced for motor M1 being the current of this motor in de-coupled state raised with 50% of said difference. By doing so the current of motor M2, which is speed controlled, is allowed to increase to $I_7$ till a stationary value is reached. The losses in the transfer contact zone X2 are and will remain equally balanced over motor M1 and motor M2. The command "start printing" may now be given.

The web is still de-coupled. At points E and F respectively, motor M3, and motor M4, are started-up in order to bring the web to a predetermined tension corresponding with a torque $W_{nom}$, and advance it in the direction as indicated by the arrow at a speed of about $S_{nom}$. Motor M4 is torque controlled and is operated such as to provide the required web tension. Motor M3 is speed controlled. The speed of the paper web 12 is measured by detecting signals from the encoder 48 and at least the current and voltage values of M3 are noted. The control device 22 adjusts the voltage applied to the motor M4 so as to approximately match the speed of the paper web 12 with that of the transfer belt 14. Before the first image reaches the final transfer zone X3, the roller 38 is moved to the coupled position to bring the paper web and the transfer belt into contact with each other at the final transfer zone X3.

Due to the coupling action, at point G, motor M2 goes into a torque controlled mode and its current equals the set point current $I_{10}$. Motor M3 is still speed controlled. Due to the losses created by the coupling in the transfer contact zone X3, i.e. the additional load, the current of motor M3 increases from $I_8$ to $I_9$. This is now a clearly unbalanced situation. A balanced situation can be obtained as follows.

At point H, the set point current $I_7$ of the torque controlled motor M2 is gradually increased to $I_{11}$ till the current of motor M3 equals the current $I_8$ of this motor in its de-coupled state. Then, the current $I_{11}$ of motor M2 is measured and the difference is calculated between this current and the current $I_7$ of motor M2 prior to the coupling to the web.

Finally, at point J, a new set point current $I_{13}$ is introduced for motor M2 being the current $I_{10}$ of this motor prior to the coupling to the web raised with 50% of said difference. By doing so the current of motor M3, which is speed controlled, is allowed to increase till a stationary value $I_{12}$ is reached. The losses in the transfer contact zone X3 are and will remain equally balanced over motors M2 and M3.

In fully coupled position the respective drive motors M1, M2, M3, M4 are operated such that the losses in the respective contact transfer zones are balanced over the respective motors, while the paper web, being advanced at a predetermined speed $S_{nom}$, and tensioned at $W_{nom}$, masters the entire system. For each motor speed (S) and current (I) are noted over time.

The printer is now in the fully coupled position, as shown in FIG. 1. In this position, toner images deposited upon the image-carrying belt 10 are transferred to the transfer belt 14 at the intermediate transfer nip at the transfer zone X2 by means of an electrostatics-assisted transfer. In order to transfer the toner images from the transfer belt 14 to the paper web 12, the toner images on the transfer belt are heated by the radiant heating device 19 to a temperature sufficient for the toner particles to become tacky. This feature, together with a pressure applied at the final transfer nip at the transfer zone X3, ensures substantially complete transfer of the toner images to the paper web, and the fixing of the images thereon.

The printer is adapted for duplex printing by including a further image-carrying belt 23, and a further transfer belt 26 capable of being coupled with the further image-carrying belt 23 and the paper web 12 to transfer images from the further image-carrying belt 23 to the opposite face 24 of the paper web 12. The further image-carrying belt 23 and the further transfer belt 26 have respective controllable further drive motors M6, M5 associated therewith.

A plurality of coloured toner images are deposited by means of electrostatics in register with each other upon the further image-carrying belt 23 from the photoconductive surfaces of a plurality of image-forming drums, of which only one drum 15 is shown in the Figures for the sake of clarity. The image-carrying belt 23 is driven by a DC drive motor M6, connected to the control device 22. An encoder 47 mounted on the image forming drum 15 and thereby driven by the image-carrying belt 23, measures the speed of the image-carrying belt 23, and feeds this information to the control device 22.

The image-carrying belt 23 passes over a guide roller 33, in contact with the further transfer belt 26. The transfer belt 26 passes over a guide roller 35 positioned in opposition to the guide roller 33, guide roller 37 and drive roller 41. In the coupled position shown in FIG. 1, the image-carrying belt 23 is in contact with the transfer belt 26 to form a closed nip of a third transfer nip X4 between the two belts. The position of the guide roller 33 can be adjusted between the coupled position and a de-coupled position where the two belts are spaced from each other and the nip of the third transfer zone X4 is opened, as shown in FIG. 2. A controllable DC drive motor M5, connected to the control device 22, is provided for driving the transfer belt 26. A fixed optical sensor 43 is provided for detecting the passage of timing marks on the transfer belt 26 past that location so as to enable the speed of the transfer belt 26 to be measured.

The web 12 passes over a guide roller 39 so positioned, in the coupled position of the web 12 with the transfer belt 26, to form a closed nip of fourth transfer zone X5 therebetween, as shown in FIG. 1. The counter roller 38 is movable to enable the web 12 and the transfer belt 26 to be de-coupled from each other and nip of the fourth transfer zone X5 opened, as shown in FIG. 2. A fixed optical sensor 45, connected to the control device 22 is provided for detecting the passage of images on the paper web 12 past that location.

In use, the further image-carrying belt 23 and the further transfer belt 26 are driven while de-coupled from each other, and their speeds are matched to that of the first transfer belt 14. Thereafter the further transfer belt 26 is coupled with the further image-carrying belt 23 and then with the paper web 12.

When the image-carrying belt 23 and the transfer belt 26 are coupled, the toner images on the image-carrying belt 23 are transferred to the transfer belt 26 at the nip of the third transfer zone X4 by electrostatics. In order to transfer the toner images from the transfer belt 26 to the paper web 12, the toner images on the transfer belt are heated by a radiant heating device 49 to a temperature sufficient for the toner particles to become tacky. This feature, together with a pressure applied at the nip of the fourth transfer zone X5, ensures substantially complete transfer of the toner images to the paper web, and the fixing of the images thereon.

At start-up, the printer is operated as follows.

In the fully de-coupled position first motors M1 and M2 are ramped up such that the speeds of the first image-carrying belt and the first transfer belt match $S_{nom}$. Before the first image reaches the first intermediate transfer nip at the transfer zone X2, the roller 32 is moved to the coupled position to bring the first image-carrying belt 10 and the first transfer belt 14 into contact with each other at the intermediate transfer contact zone X2. Due to the coupling action, motor M1 goes into a torque controlled mode. The losses created by the coupling in the transfer contact zone X2 are equally balanced over motor M1 and motor M2 as depicted in FIG. 3. Next the same procedure is repeated for the second image carrying belt driven by motor M6 and the second transfer belt 26 driven by motor M5. In the de-coupled position, power is applied to the drive motors M6 and M5. The speed of the second transfer belt is measured by detecting signals from the optical sensor 43.

The speed of the second image-carrying belt 23 is measured by detecting signals from the encoder 47 and the power applied to the drive motor M6 is noted. The control device 22 adjusts the voltage applied to the motor M6 such that the speeds of the second image-carrying belt 23 and that of the second transfer belt 26 match $S_{nom}$. Before the first image reaches the third transfer contact zone X4, the roller 33 is moved to the coupled position to bring the second image-carrying belt and the second transfer belt into contact with each other at nip of the third transfer zone X4. Due to the coupling action, motor M6 goes into a torque controlled mode. The losses created by the coupling in the third transfer contact zone X4 are equally balanced over motors M6 and M5. Both belt systems run now independent at about the same speed controlled by motors M2 and M5 independently. Preferably motor M5 is synchronized on motor M2. Thereafter, the de-coupled web is tensioned and brought up to speed, $S_{nom}$, as described in FIG. 3, by motors M3 and M4. Subsequently, the rollers 38 and 39 are moved to the coupled position to bring the paper web and the respective transfer belts 14, 26 into contact with each other such that the losses created at the respective transfer contact zones are balanced over the respective motors, i.e. M2 and M3, and M5 and M3 or M4 dependent on the place where one would like to have nominal web tension.

The printer is now in the fully coupled position, as shown in FIG. 1. In this position, toner images transferred to the image-carrying belt 23 are transferred to the transfer belt 26 at the transfer nip at the transfer zone X2, are heated thereon to a tacky state by the heater 49, are transferred to the opposite face 24 of the paper web 12 at the nip of the fourth transfer zone X5 and are fixed thereon.

What is claimed is:

1. An image reproduction system which includes a device for transferring developed images from an image-carrying member to one face of a receptor material, comprising:

a transfer member capable of being coupled with, and decoupled from, both said image-carrying member and said receptor material, wherein said transfer member and said receptor material pass over respective guide rollers so positioned, in the coupled position of said transfer member with said receptor material, to form a transfer contact zone therebetween;

a first drive device for tensioning said receptor material; and a second and a third drive device, both capable of speed and torque control, for driving said transfer member and said receptor material respectively such that the additional load created in said transfer contact zone is shared between said second and third drive device.

2. An image reproduction system as recited in claim 1, wherein at least one of said guide rollers is movable to enable said transfer member and said receptor material to be de-coupled from each other.

3. An image reproduction system as recited in claim 1, wherein said receptor material is in the form of a web.

4. An image reproduction system as recited in claim 1, wherein said receptor material is in sheet form and supported on a conveyor, said conveyor being driven by said first and third drive device.

5. An image reproduction system as recited in claim 1, wherein said first, second and third drive devices are in the form of first, second and third independently controllable drive motors.

6. An image reproduction system as recited in claim 1, wherein said image-carrying member and said transfer member pass over respective guide rollers so positioned, in the coupled position of said image-carrying member with said transfer member, to form an intermediate transfer contact zone therebetween and further comprising a fourth drive device, capable of speed and torque control, for driving said image-carrying member such that the additional load created in said intermediate transfer contact zone is shared between said second and fourth drive device.

7. An image reproduction system as recited in claim 6, wherein at least one of said guide rollers is movable to enable said image-carrying member and said transfer member to be de-coupled from each other.

8. An image reproduction system as recited in claim 6, wherein one or both of said image-carrying member and said transfer member are in the form of endless belts.

9. An image reproduction system as recited in claim 8, further comprising a heater for heating said transfer member prior to said transfer contact zone.

10. An image reproduction system as recited in claim 1, adapted for duplex printing, further comprising a further image-carrying member, a further transfer member capable of being coupled with said further image-carrying member and said receptor material to transfer images from said further image-carrying member to the opposite face of said receptor material, said further image-carrying member and said further transfer member having respective controllable further drive devices associated therewith.

11. A method for controlling image distortion in the transfer contact zone between a first and a second moving image-carrying member, being part of an image reproduction system, the method comprising:

driving said first image-carrying member with a first drive device, capable of speed and torque control; and driving said second image-carrying member with a second drive device, capable of speed and torque control, wherein said first drive device and said second drive device are coupled to different sides of the transfer contact zone such that the force exerted by the first moving image-carrying member on the second moving image-carrying member is countered by the force exerted by the second moving image-carrying member on the first moving image-carrying member.

12. A method as recited in claim 11, wherein said forces are countered by substantially equally dividing the additional load created in the transfer contact zone by engaging said first moving image-carrying member against said second moving image carrying member over said first and said second drive device.

13. A method as recited in claim 12, further including adjusting the speeds of said image-carrying member, said transfer member and said receptor material while said transfer member is de-coupled from said image-carrying member and said receptor material, such that prior to be coupled to each other said transfer member, said image-carrying member and said receptor material will all be moving at the same speed within predetermined tolerances.

14. A method as recited in claim 11, wherein said first image-carrying member and said second image-carrying member are driven in a smooth and slipless way in order to control image distortion and particularly image stretching and shrinkage in said transfer contact zone.

* * * * *